US006695169B1

(12) United States Patent
Dambricourt

(10) Patent No.: US 6,695,169 B1
(45) Date of Patent: Feb. 24, 2004

(54) TUBE WHICH EMPTIES COMPLETELY

(75) Inventor: Gery Bernard Marie Cornil Dambricourt, Escoutoux (FR)

(73) Assignee: CEP Industrie, St. Remy sur Durolle (FR)

( * ) Notice: Subject to any disclaimer, the term of this patent is extended or adjusted under 35 U.S.C. 154(b) by 0 days.

(21) Appl. No.: 09/959,257

(22) PCT Filed: Apr. 20, 2000

(86) PCT No.: PCT/FR00/01044

§ 371 (c)(1),
(2), (4) Date: Jan. 15, 2002

(87) PCT Pub. No.: WO00/64769

PCT Pub. Date: Nov. 2, 2000

(30) Foreign Application Priority Data

Apr. 23, 1999 (FR) ..... 99 05192

(51) Int. Cl.[7] ..... B65D 35/00
(52) U.S. Cl. ..... 222/92; 222/107
(58) Field of Search ..... 222/92, 107

(56) References Cited

U.S. PATENT DOCUMENTS 2,941,694 A * 6/1960 Harman ..... 222/107
2,970,723 A * 2/1961 Flax ..... 222/107
5,484,083 A 1/1996 Joulia
6,393,675 B1 * 5/2002 Gaetke ..... 24/563
6,419,119 B1 * 7/2002 Tam ..... 222/107

FOREIGN PATENT DOCUMENTS

| | | |
|---|---|---|
| DE | 2914370 | 10/1980 |
| EP | 665168 | 8/1995 |
| FR | 2105590 | 4/1972 |
| WO | WO 96/30272 | 10/1996 |

* cited by examiner

*Primary Examiner*—Joseph A. Kaufman
(74) *Attorney, Agent, or Firm*—Leydig, Voit & Mayer, Ltd.

(57) ABSTRACT

The invention concerns a packaging tube for pasty product, comprising a tubular skirt extending along an axial direction and sealed by swaging at the end of the tube, and a head located at the other end of the tube, the head including a dispensing passage and a neck forming a radial extension of the dispensing passage, the neck being connected to the skirt by a connecting surface. The skirt and the connecting surface have, respectively, a circumference and a radius of curvature such that the ratio of the circumference over the radius is not more than 20.

12 Claims, 3 Drawing Sheets

TUBE WHICH EMPTIES COMPLETELY

FIELD OF THE INVENTION

The present invention relates generally to packages in tube form, which are traditionally used for the packaging of pasty products such as dentifrice, pharmaceutical products, creams and various cosmetology products, food products, glues, mastics, etc.

BACKGROUND

A general problem encountered in ordinary use of tubes lies in the fact that it is impossible to empty them completely of their contents, resulting in a loss of packaged product, with unavoidable negative effects from both the economic and the ecological standpoints.

A tube is diagrammatically described in the patent document DE-2914370 in order to solve this problem.

Although the solution proposed by this patent, which consists of reducing the angle between the neck and the axis of the tube, is both useful and relatively effective, the adjustment of the parameter constituted by this angle does not enable one to solve the problem mentioned above in all the cases in point, that is to say with tubes of various sizes, consisting of different materials and enclosing products of various viscosities.

Furthermore, known, for example, through patent documents WO 96/30272 and FR 2 105 590 are flexible tubular bottles which, although they have considerable variations of thickness according to a transverse direction, aim to solve the same problem.

In reality, these containers not only pose relatively intense manufacturing problems but they are also found to be subject to an unsolvable compromise between the risk of air tightness failure of the zones of lesser thickness, with the need, in order to avoid this risk, to increase the extra thickness of the zones of greater thickness, and the industrial need to produce tubes with a minimum of material.

SUMMARY OF THE INVENTION

The invention is situated in this context and proposes a tube which empties completely, making it possible to palliate the limitations and problems mentioned above.

The invention more precisely relates to a packaging tube which has: a tubular skirt elongated in an axial direction, the skirt having a filling end closed off by collapsing of the skirt in a transverse direction and forming a first end of the tube; and a head situated at a second end of the tube, away from the filling end, the head having a channel for distribution of the pasty product and a neck in the form of a radial extension of the distribution channel, the neck being connected to the skirt by a connecting surface, the connecting surface having, in a longitudinal plane containing the axial direction and perpendicular to the transverse direction, a particular minimum radius, and the skirt having, in a plane transverse to the axial direction and situated midway between the ends of the tube, a particular circumference and a roughly constant thickness.

For this purpose, the tube of the invention is characterized by the fact that the ratio of the particular circumference to the minimum radius is less than twenty (that is to say less than $6\pi$) and preferably at most equal to ten (that is to say barely over $3\pi$).

Furthermore, with respect to the axial direction, the neck preferably has a maximum inclination less than 60 degrees.

In practice, it can prove useful to give the connecting surface, with respect to the axial direction, a maximum inclination of, at most, 45 degrees or even, at most, equal to 30 degrees.

In order to make the tube of the invention even easier to use, it is moreover possible to make the ratio of the average thickness of the neck to the average thickness of the skirt at most equal to 2.

According to a preferred embodiment, the skirt and the head are produced in the form of a single piece, without a connecting zone.

In the case corresponding to a preferred application of the invention, and in which the tube is produced by injection of a thermoplastic material and must be made air tight in order to ensure the protection of its contents, this tube is preferably covered on its whole surface, including the head, with a protective varnish called a "barrier varnish," for example, deposited by spraying.

Contrary to the prior art, in which the tube skirts are obtained by extrusion, it is possible in the invention to define the skirt by a generating line not parallel to the axial direction of the tube.

Finally, the ease of use of the tube of the invention is further improved by choosing, for the skirt and the head, an elastically extendible material having very satisfactory flexibility.

BRIEF DESCRIPTION OF THE DRAWINGS

Other characteristics and advantages of the invention will emerge clearly from the description given hereafter in an indicative and in no way limiting basis in reference to the appended drawings in which.

DETAILED DESCRIPTION

Figure 1:
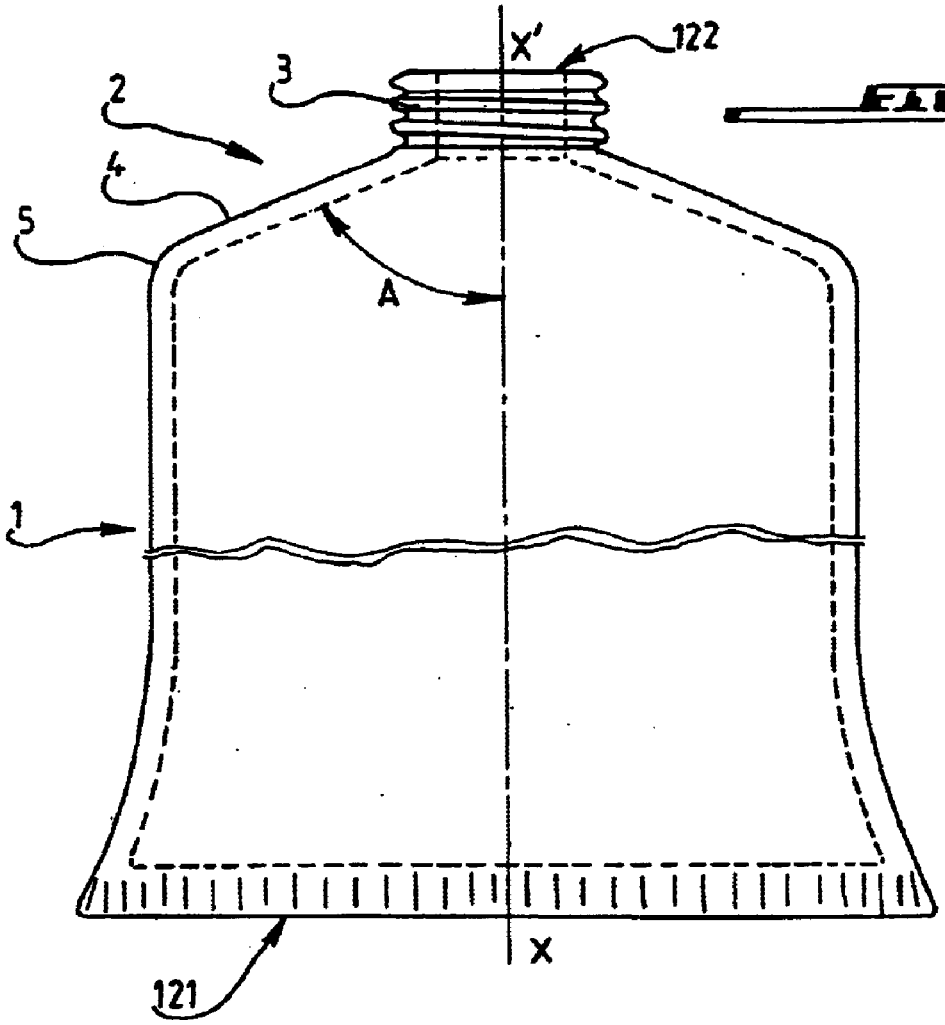
FIG. 1 is a front view of a known packaging tube, shown before use.

As shown by all the figures, the invention relates generally to a packaging tube for a pasty product, which essentially has tubular skirt 1 and head 2.

In a preferred embodiment, head 2 and skirt 1 are produced in the form of a single piece, with no connecting zone.

The skirt has an elongated shape along an axial direction XX' and ends, including a filling end 121 which, after injection of the product which is to be packaged, is closed off by collapsing of this skirt 1, possibly with heat, along a transverse direction ZZ'.

Head 2, which is situated at end 122 of the tube away from filling end 121, has a distribution channel 3 for the packaged product, and a neck 4 in the form of radial extension of channel 3 and which is connected to skirt 1 by a connecting surface 5.

Figure 2:
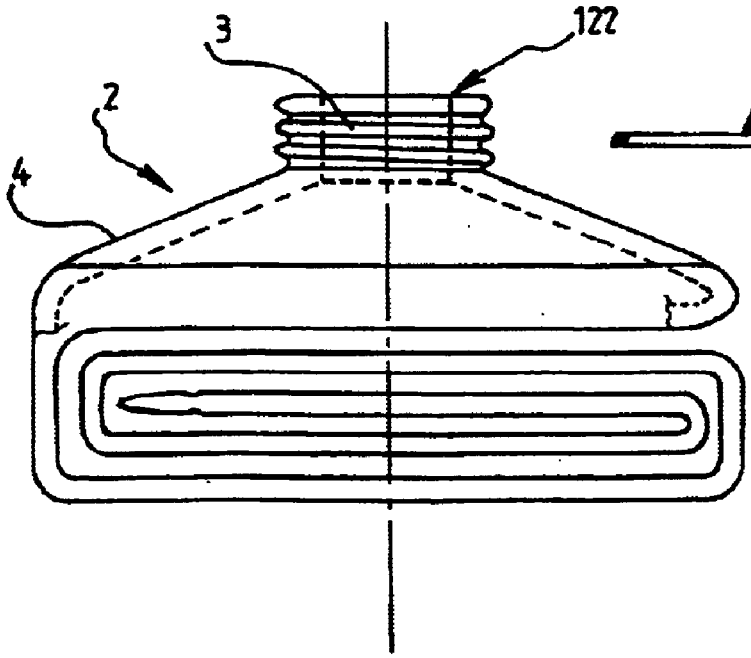
FIG. 2 is a front view of a known packaging tube, shown after use.
Figures 3, 4, 5:
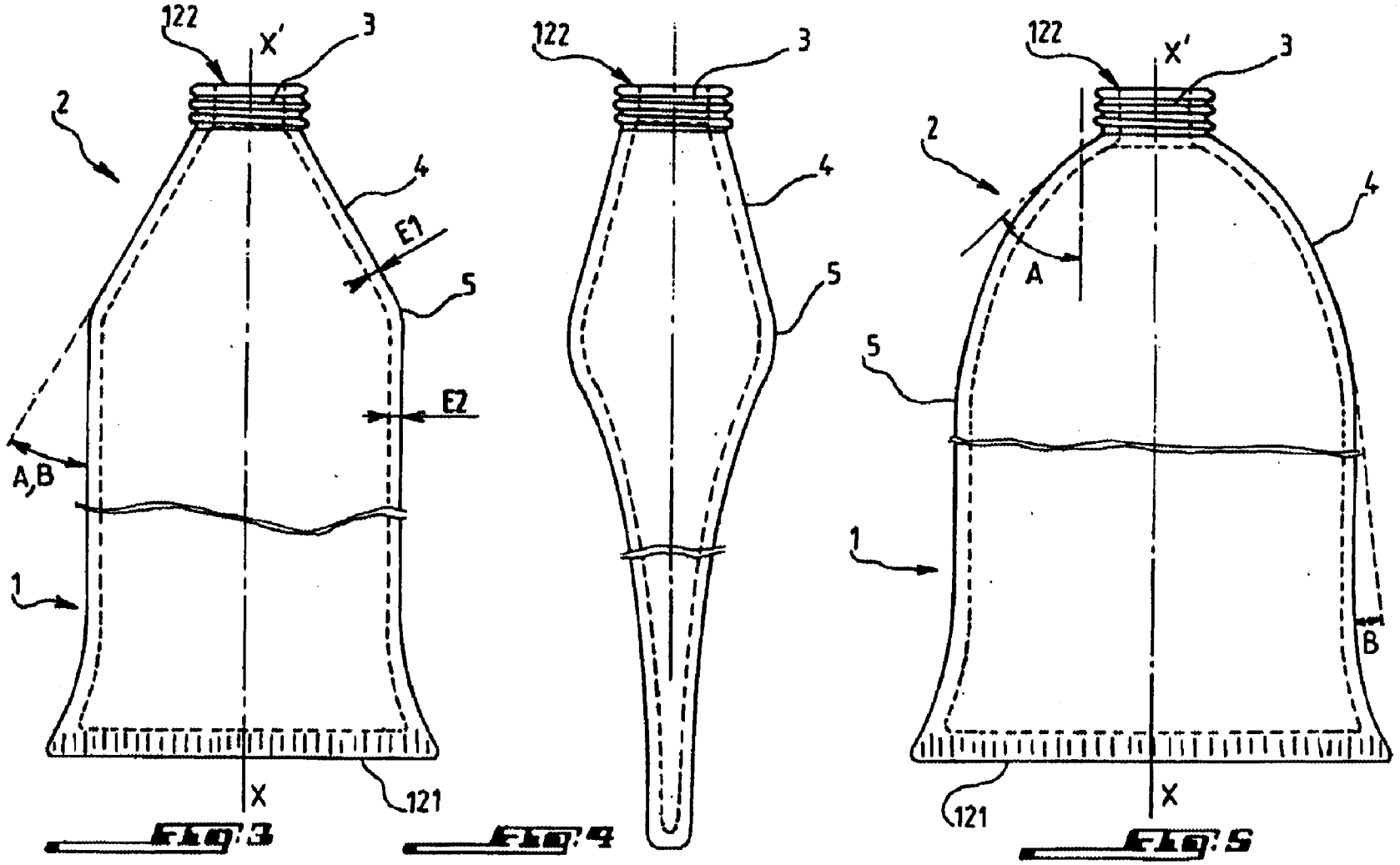
FIG. 3 is a front view of a packaging tube according to a first embodiment of the invention, shown before use.
FIG. 4 is a front view of a packaging tube according to a first embodiment of the invention, shown after use.
FIG. 5 is a front view of a packaging tube according to a second embodiment of the invention, shown before use.
Figure 7:
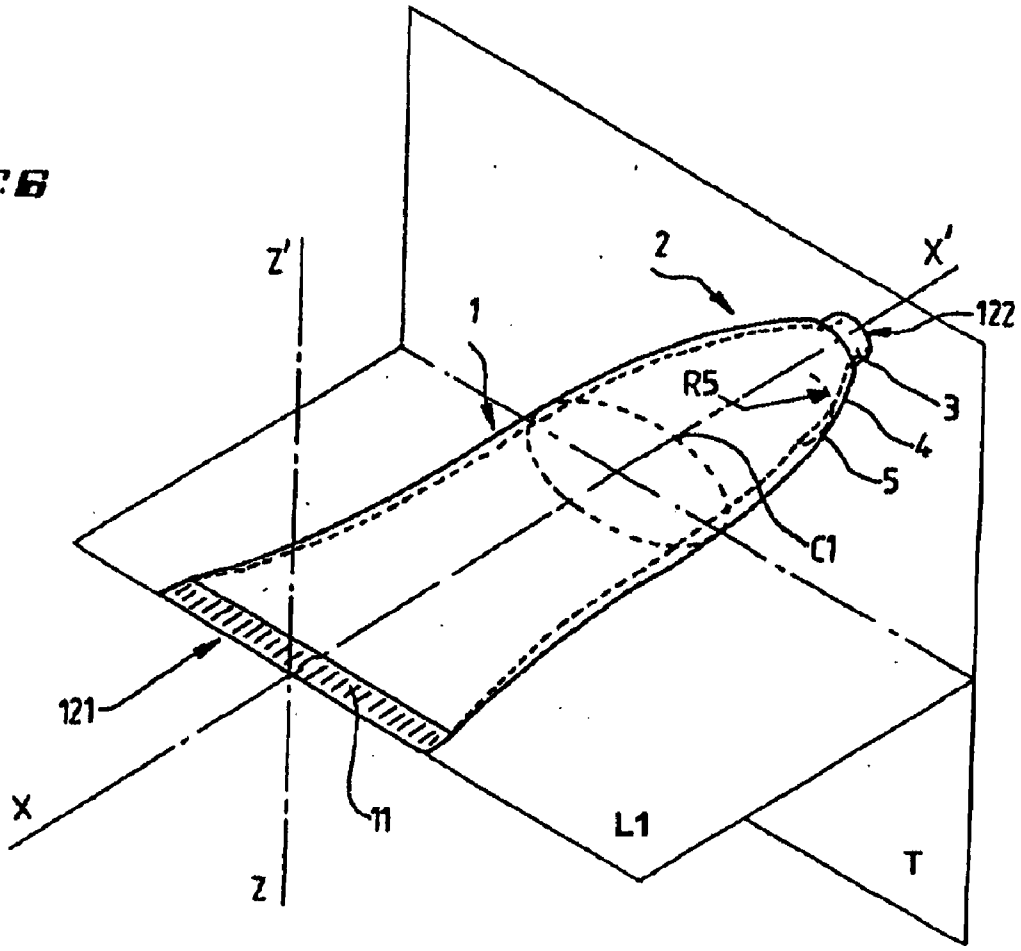
FIG. 7 is a perspective view of the packaging tube illustrated in FIG. 6.

The problem encountered in emptying the tubes of prior art at the end of use is illustrated in FIGS. 1 and 2 and lies in the fact that it is impossible to collapse the head in order to make the product remaining there come out of it.

In order to limit the loss of product generated by the packaging in the form of a tube, the solution traditionally adopted in the prior art consists of reducing the volume of the product which cannot be expelled from the tube at the end of use.

Thus, the most conventional known approach has always led to providing the greatest slope of neck 4 and of connecting surface 5 to make an angle A, with respect to the axial direction XX', which corresponds to the greatest possible inclination and, in all cases, equals 60 degrees.

The present invention, which like document DE-2914370 proceeds in exactly the opposite manner and which seeks not to reduce the lost volume of packaged product but rather to avoid any loss of product, on the contrary, recommends preferably making the neck 4 have, with respect to the axial direction XX', a maximum inclination A of less than 60 degrees.

Depending on the material used for producing the tube and on the thickness of the head, it is even preferable to give the connecting surface 5, with respect to the axial direction XX', a maximum inclination B which is, at most, equal to 45 degrees, and, even possibly, at most, equal to 30 degrees.

But in any case, the invention provides associating with these preferred characteristics a particular choice of parameters relating to the general shape of the tube, making it possible to use materials with various deformation capabilities for the manufacturing of the tube.

The first parameter to be taken into consideration is the smallest radius R5 of connecting surface 5 in the longitudinal plane L1 which contains the axial direction XX' and which is perpendicular to the transverse direction ZZ'.

The second parameter to be taken into consideration is the circumference C1 of the skirt in a transverse plane T perpendicular to the axial direction XX' and situated midway between ends 121, 122 of the tube.

Hypothetically, skirt 1 furthermore has, in any transverse plane parallel to plane T, a local thickness which is both roughly constant and equal to or very close to equal to the average thickness E2 of this skirt over its whole length along axis XX'.

According to its fundamental aspect, the invention thus provides giving the ratio C1/R5 of circumference C1 to the minimum radius R5 a value less than 20 (that is to say less than $6\pi$), preferably, at most equal to ten (that is to say barely over $3\pi$), and most preferably, not larger than 1.5.

According to another aspect of the invention, the ease of pressing at the end of use of the tube can be improved by giving skirt 1 and neck 4 identical or very similar average thicknesses, or at least by giving the ratio of the average thickness of the neck to the average thickness of the skirt a value at most equal to 2.

Inasmuch as the thickness of the tube according to the invention, particularly at the site of the neck, must be rather small in order to ensure great flexibility of the head and can consequently become insufficient to ensure the tightness of the tube with regard to air, and, more particularly, the oxygen contained in the air, and to preserve the contents of the tube, it is preferable to cover the tube with a barrier varnish over its whole external surface including head 2; distribution channel 3 can, however, be free of this coating inasmuch as it can have a greater thickness with no problem.

However, since the tube according to the invention can assume a relatively complex shape, which can furthermore aim for a particular aesthetic result, it is preferable to deposit this barrier varnish by spraying, and not by use of a roller as is generally done in prior art.

The invention applies preferably to the production of tubes whose skirt 1 and head 2 are formed in a single piece by injection of a thermoplastic material which has an elastic extension capability in its plane of at least five percent, preferably, and, possibly, more than ten percent.

Figure 6:
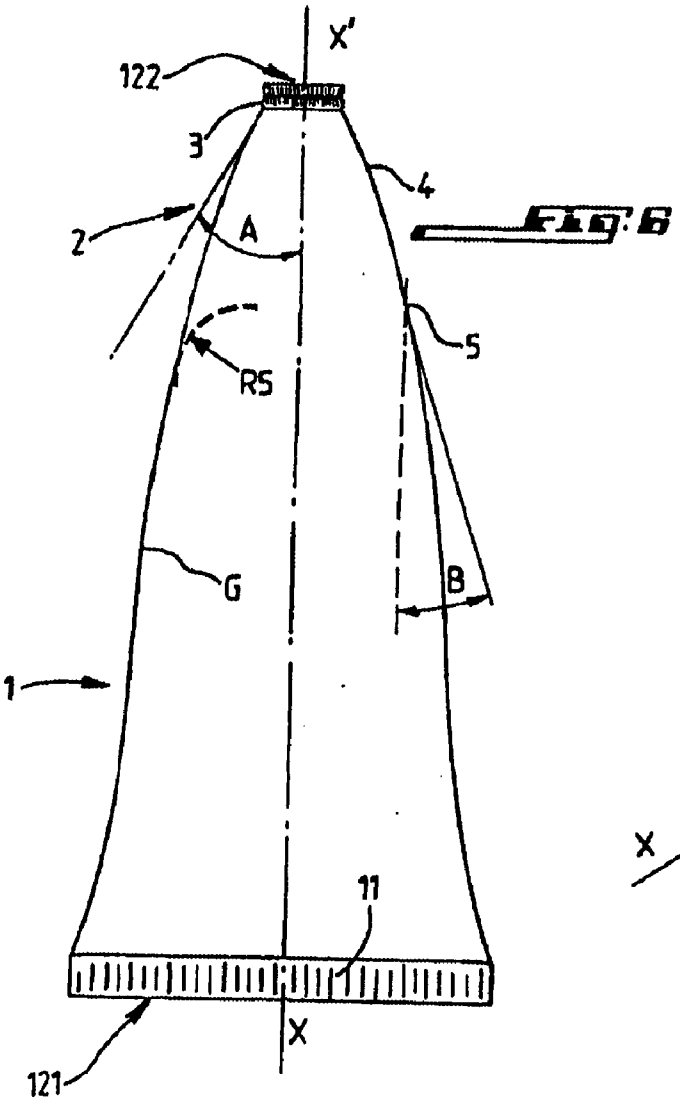
FIG. 6 is a front view of a packaging tube according to a third embodiment of the invention, shown before use.

As shown in FIG. 6, the skirt can then be defined by a generating line G not parallel to the axial direction XX', thus, there is more freedom as to the shape of the tube than in the prior art.

What is claimed is:

1. A packaging tube for a pasty product, the packaging tube including:

a tubular skirt elongated along a central axis of the packaging tube, and having a filling end closed by collapsing of the tubular skirt in a transverse direction and forming a first end of the packaging tube;

a head at a second end of the packaging tube, remote from the first end, and having a distribution channel for the pasty product and a neck as a radial extension of the distribution channel; and a connecting surface connecting the neck to the tubular skirt, the connecting surfaced having, in plane including the central axis, a radius of curvature transverse to the central axis, and the skirt having, in a plane transverse to the central axis and situated midway between the first and second ends of the packaging tube, a circumference and a generally constant thickness, wherein a ratio of the circumference to the radius of curvature is no more than twenty.

2. The packaging tube according to claim 1, wherein the ratio of the circumference to the radius is no more than ten.

3. The packaging tube according to claim 1, wherein, with respect to the central axis, the neck has a maximum inclination of less than 60 degrees.

4. The packaging tube according to claim 1, wherein the connecting surface has, with respect to the central axis, a maximum inclination of 45 degrees.

5. The packaging tube according to claim 4, wherein the connecting surface has, with respect to the central axis, a maximum inclination of 30 degrees.

6. The packaging tube according to claim 1, wherein the tubular skirt and the neck have respective first and second average thicknesses and a ratio of the second average thickness to the first average thickness is, at most, equal to two.

7. The packaging tube according to claim 1, wherein the tubular skirt and the head are a thermoplastic material.

8. The packaging tube according to claim 1, including a barrier varnish covering the packaging tube, including the head.

9. The packaging tube according to claim 1, wherein the skirt is defined by a generating line not parallel to the central axis.

10. The packaging tube according to claim 1, wherein the skirt and the head are an elastically extendible material.

11. The packaging tube according to claim 1, wherein the tubular skirt and the head are a single piece.

12. The packaging tube according to claim 1, wherein the ratio does not exceed 1.5.

* * * * *